US010764685B2

(12) United States Patent
Song

(10) Patent No.: US 10,764,685 B2
(45) Date of Patent: Sep. 1, 2020

(54) SPEAKER

(71) Applicant: AAC Technologies Pte. Ltd., Singapore (SG)

(72) Inventor: Wei Song, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/524,042

(22) Filed: Jul. 27, 2019

(65) Prior Publication Data

US 2020/0045428 A1 Feb. 6, 2020

(30) Foreign Application Priority Data

Aug. 4, 2018 (CN) ..... 2018 2 1270199 U

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 7/20*** | (2006.01) |
| ***H01F 7/08*** | (2006.01) |
| ***H04R 9/02*** | (2006.01) |
| ***H01F 7/126*** | (2006.01) |

(52) U.S. Cl.

CPC ..... *H04R 7/20* (2013.01); *H01F 7/081* (2013.01); *H01F 7/126* (2013.01); *H04R 9/025* (2013.01); *H04R 9/06* (2013.01)

(58) Field of Classification Search

CPC .. H04R 7/00; H04R 9/025; H04R 9/06; H01F 7/081; H01F 7/126

See application file for complete search history.

(56) References Cited

U.S. PATENT DOCUMENTS

2014/0056446 A1* 2/2014 Li ..... H04R 1/00 381/162
2014/0056465 A1* 2/2014 Li ..... H04R 9/025 381/400
2014/0294228 A1* 10/2014 Itano ..... H04R 9/025 381/414
2015/0163597 A1* 6/2015 Meng ..... H04R 9/025 381/412
2015/0181345 A1* 6/2015 Cai ..... H04R 9/06 381/412
2016/0112804 A1* 4/2016 Xiao ..... H04R 9/025 381/398
2016/0241938 A1* 8/2016 Huang ..... H04R 1/023
2017/0013382 A1* 1/2017 Zhang ..... H04R 29/003
2017/0134862 A1* 5/2017 Ma ..... H04R 7/12
2017/0134863 A1* 5/2017 Ma ..... H04R 9/025

(Continued)

*Primary Examiner* — Simon King
(74) *Attorney, Agent, or Firm* — W&G Law Group LLP

(57) ABSTRACT

The present disclosure provides an improved speaker including a suspension accommodated in a magnetic gap formed by a main magnet and an auxiliary magnet. The suspension is used for supporting a coil assembly of the speaker. The auxiliary magnet further includes a capacity-increased space for accommodating the suspension and providing the suspension with more space to vibrate and providing the suspension with better flexibility. In order to more firmly fix the suspension, the auxiliary magnet further includes a fastening slot for engaging with an edge of the suspension. Optionally, the auxiliary magnet is configured to be a two-piece structure.

10 Claims, 4 Drawing Sheets

(56) References Cited

U.S. PATENT DOCUMENTS

| | | | | |
|---|---|---|---|---|
| 2018/0367885 | A1* | 12/2018 | Gong | H04R 9/06 |
| 2019/0141453 | A1* | 5/2019 | Kim | H04R 3/00 |
| 2019/0261092 | A1* | 8/2019 | Landick | G06F 1/1688 |
| 2019/0313193 | A1* | 10/2019 | Danovi | H04R 9/06 |

* cited by examiner

SPEAKER

FIELD OF THE PRESENT DISCLOSURE

The present disclosure relates to the field of electromagnetic transducers, more particularly to a speaker used in a portable electronic device.

DESCRIPTION OF RELATED ART

A speaker is a very important component equipped in a mobile phone for producing audible sounds. A speaker generally uses a diaphragm to produce vibration and further to generate sounds.

In order to adapt to miniaturization and multifunctional development of various audio equipment and information communication equipment, the speaker used in the equipment is more likely to be more miniaturized. The matching of other elements on the periphery of the loudspeaker is more compact. The vibration system and the magnetic circuit system of the speaker are directly connected with the sound quality of the speaker. The vibration system of a related speaker comprises a vibrating diaphragm and a voice coil assembly attached to the vibrating diaphragm. The magnetic circuit system comprises a yoke and a magnet arranged in the yoke. The coil fixedly supported by only the vibrating diaphragm, and when the vibrating system vibrates, unbalanced vibration is easily generated. The power is required to be reduced to meet the balance of the vibration system, and therefore the power of the vibration system is limited. So that the acoustic performance of the speaker using the vibration system is limited. Therefore, an improved speaker is desired.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby are only to explain the disclosure, not intended to limit the disclosure.

Figure 1:
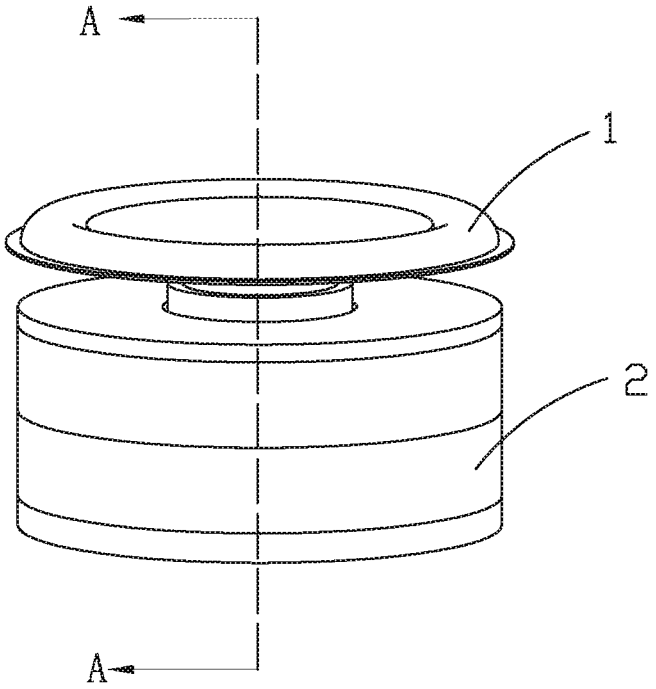
FIG. 1 is an isometric view of a speaker in accordance with an exemplary embodiment of the present disclosure.
Figure 2:
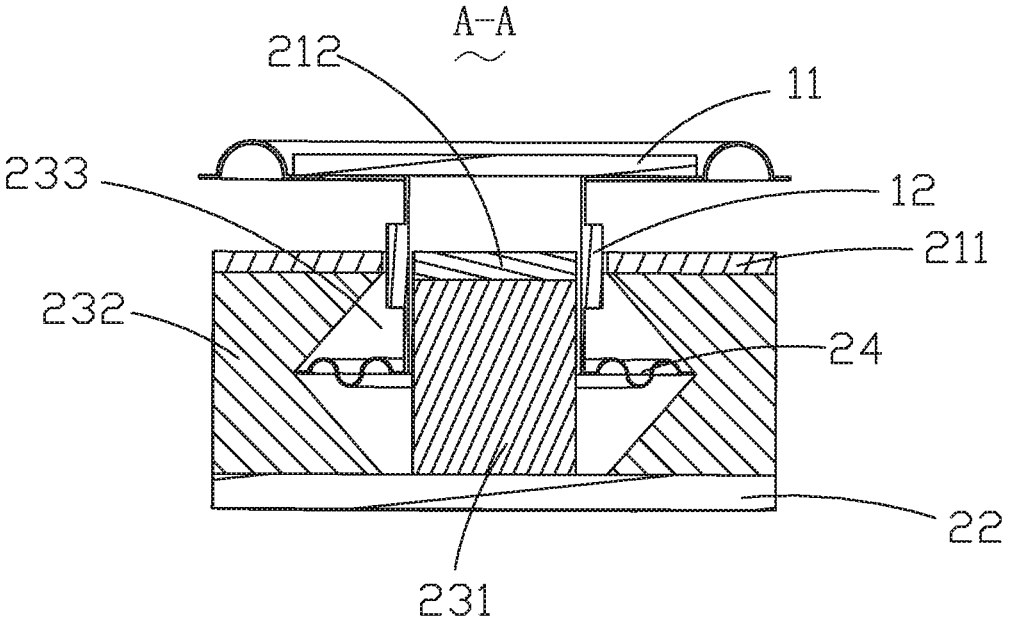
FIG. 2 is a cross-sectional view of the speaker in FIG. 1, taken along line A-A.

Referring to FIGS. 1-2, a speaker, in accordance with an exemplary embodiment of the present disclosure, includes a vibration system 1 and a magnetic circuit system 2. The vibration system 1 includes a diaphragm 11 and a coil assembly 12 for driving the diaphragm 1. The magnetic circuit system 2 includes an upper pole plate 21, a lower pole plate 22 and a magnet 23 sandwiched between the upper pole plate 21 and the lower pole plate 22. The diaphragm 11 connects to the coil assembly 12 and locates above the upper pole plate 21. The magnet 23 includes a main magnet 231 and an auxiliary magnet 232 surrounding the main magnet 231 for forming a magnetic gap 233 therebetween. The coil assembly 12 at least partially received in the magnetic gap 233. In the present disclosure, the coil assembly 12 may include a coil wound by conductive wires and coupled to a supporting member, and also may include only a coil.

Figure 4:
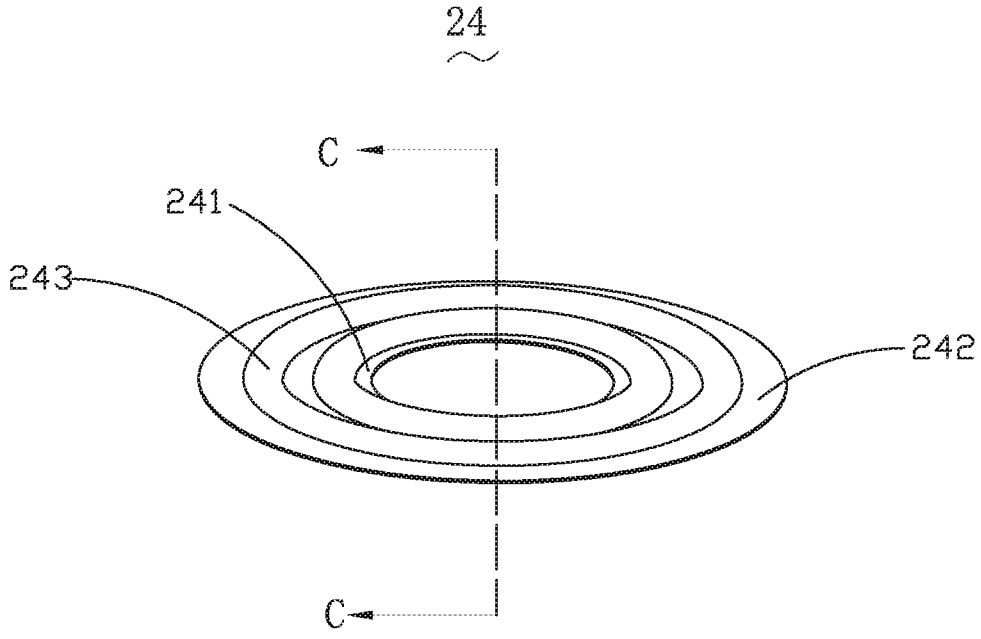
FIG. 4 is an isometric view of a suspension of the speaker in FIG. 1.
Figure 5:
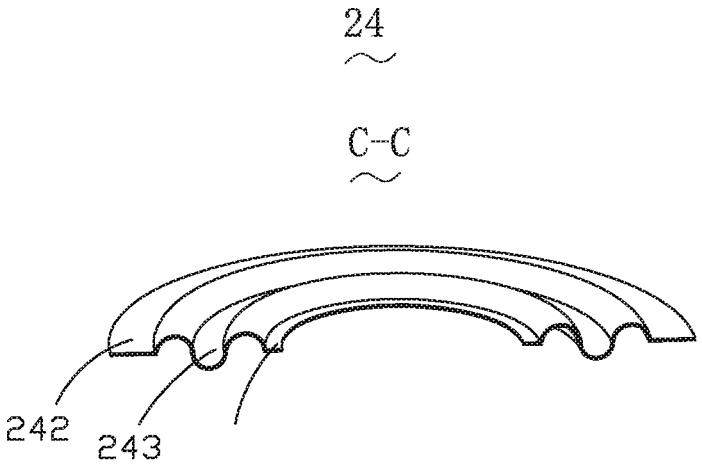
FIG. 5 is a broken view of the suspension in FIG. 4, taken along line C-C.
Figure 6:
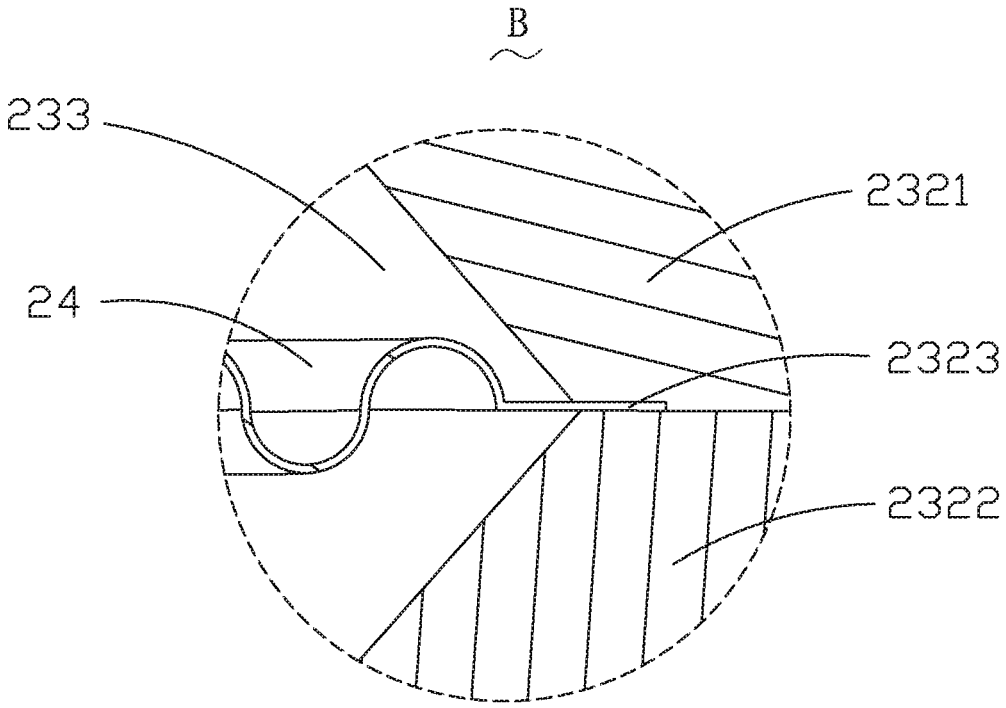
FIG. 6 is an enlarged view of Part B of FIG. 5.

Referring to FIGS. 4-5, the speaker further includes a suspension 24 accommodated in the magnetic gap 233. The suspension 24 includes a first fastening portion 241, a second fastening portion 242 and a connecting portion 243 connecting the first fastening portion 241 to the second fastening portion 242. The first fastening portion 241 connects to an end of the coil assembly 12 far away from the diaphragm 1, and the second fastening portion 242 is fixed to an inner side of the auxiliary magnet 232 adjacent to the main magnet 231.

The connecting portion 243 has a wavy cross-section along a direction parallel to a vibration direction of the diaphragm. The suspension having a wavy structure provides better damping performance, and is beneficial to the stability of the vibration system, which improves the acoustic performance of the speaker.

The first fastening portion 241 connects to and forms a right angle with the coil assembly 12, which ensures that the suspension 24 supports the coil assembly 12 better and further improves the stability of the vibration system.

The speaker provided by the present disclosure includes a suspension accommodated in the magnetic gap. The suspension has one end connected to the coil assembly and another end connected to the auxiliary magnet. The configuration of the suspension supports the coil assembly firmly, and s improves the stability of the vibration system thereby improving the acoustic performance of the speaker.

Referring especially to FIG. 2, the auxiliary magnet 232 further includes a capacity-expansion portion for increasing the space where the suspension locates. The capacity-expansion portion is formed by depressing the inner side of the auxiliary magnet adjacent to the main magnet 231.

In this manner, the auxiliary magnet 232 actually has an inner diameter at a middle portion thereof greater than an inner diameter at a top portion or a lower portion thereof. Preferably, the suspension locates where the auxiliary magnet has the greatest inner diameter, which provides the suspension with enlarged space and more flexibility. Optionally, the auxiliary magnet further includes a slot in the inner side for fixing the second fastening portion of the suspension.

Figure 3:
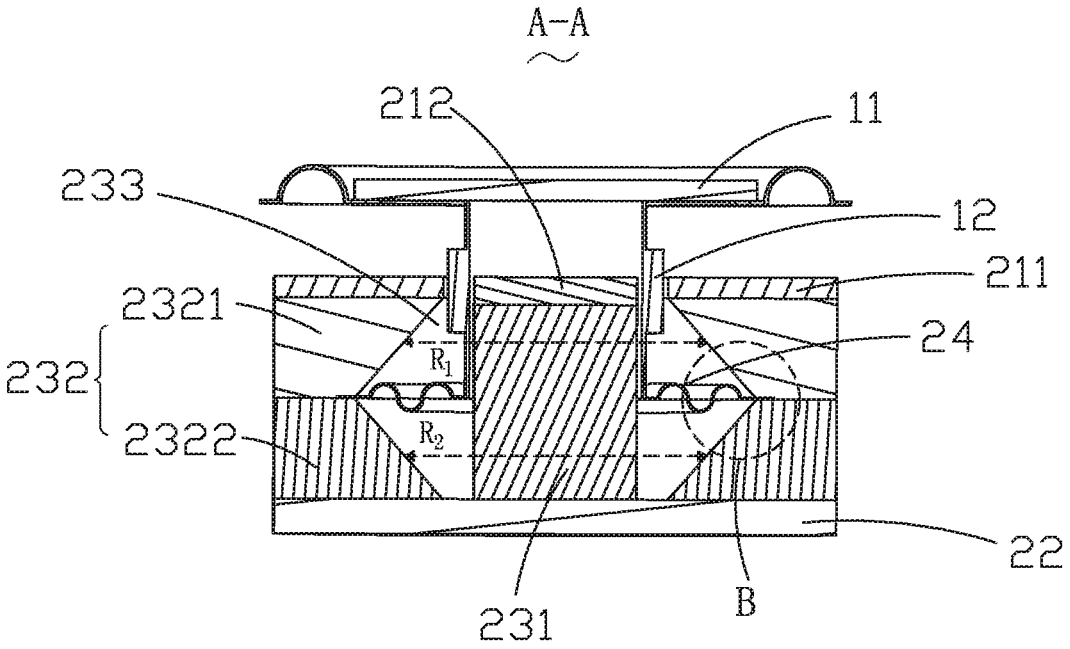
FIG. 3 is similar to FIG. 2, indicating another optional magnetic circuit system different from the magnetic circuit system in FIG. 2.

Referring to FIG. 3, another optional magnetic circuit system is provided. The auxiliary magnet 232 includes a first auxiliary magnet 2321 and a second auxiliary magnet 2322 engaging with the first auxiliary magnet 2321. Along a direction from the lower pole plate 22 toward the diaphragm 11, the second auxiliary magnet 2322 has a gradually increased inner diameter $R_2$, and the first auxiliary magnet

2321 has a gradually decreased inner diameter $R_1$. Each of the first auxiliary magnet and the second auxiliary magnet has an engaging surface defining the maximum inner diameter of the first auxiliary magnet and the second auxiliary magnet. The engaging surfaces of the first and second auxiliary magnets coincide with each other. The suspension is positioned between the engaging surfaces.

The configuration of the auxiliary magnet as shown in FIG. 3 provides more design flexibility to arrange the suspension.

Optionally, the first auxiliary magnet 2321 is symmetrical with the second auxiliary magnet 2322 about a plane where the second fastening portion 242 locates. Along the direction from the lower pole plate 22 toward the diaphragm 11, the second auxiliary magnet 2322 has a gradually increased inner diameter $R_2$, and the first auxiliary magnet 2321 has a gradually decreased inner diameter $R_1$. By virtue of the symmetrical configuration, the magnetic circuit system can provide maximized magnetic efficiency. In this embodiment, the gradually increased/decreased inner diameter is changed linearly.

Optionally, one of the engaging surfaces of the first and second auxiliary magnets is provided with a fastening slot 2323 for fastening the second fastening portion 242. Alternatively, the fastening slot 2323 can be cooperatively formed by the two engaging surfaces of the first and second auxiliary magnets.

Figure 7:
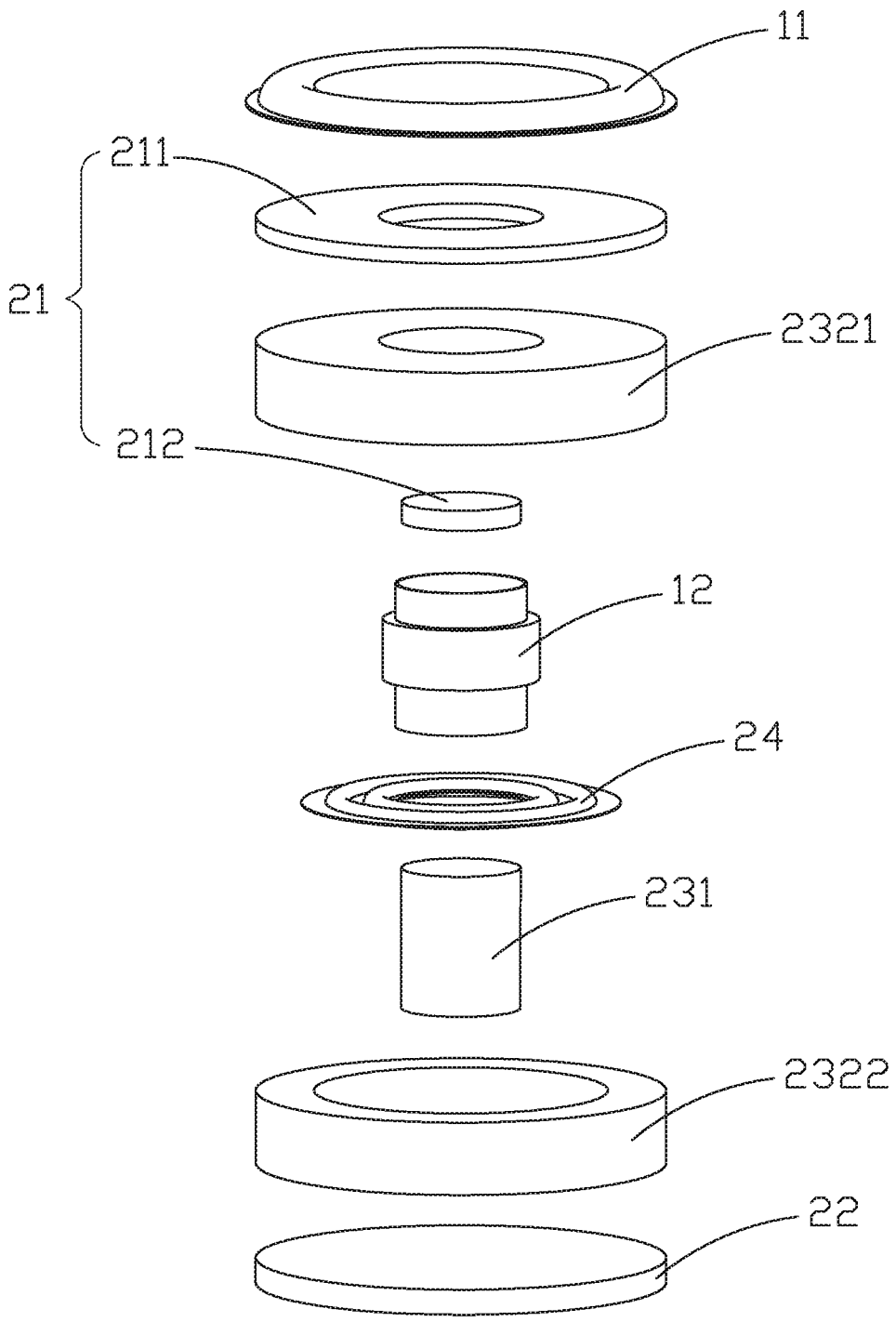
FIG. 7 is an isometric and exploded view of the speaker in FIG. 1.

Referring to FIGS. 3 and 7, the upper pole plate 21 includes a first upper plate 211 covering the main magnet 231 and a second upper plate 212 covering the auxiliary magnet 232 and forming a gap from the first upper plate 211.

The present disclosure provides an improved speaker including a suspension accommodated in a magnetic gap formed by a main magnet and an auxiliary magnet. The suspension is used for supporting a coil assembly of the speaker. The auxiliary magnet further includes a capacity-increased space for accommodating the suspension and providing the suspension with more space to vibrate and providing the suspension with better flexibility. In order to more firmly fix the suspension, the auxiliary magnet further includes a fastening slot for engaging with an edge of the suspension. Optionally, the auxiliary magnet is configured to be a two-piece structure.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker, comprising:

a vibration system including diaphragm and a coil assembly for driving the diaphragm to vibrate along a vibration direction;

a magnetic circuit system disposed below the diaphragm, including a upper pole plate, a lower pole plate, and a magnet sandwiched between the upper pole plate and the lower pole plate, the magnet including a main magnet and an auxiliary magnet surrounding the main magnet for firming a magnetic gap;

a suspension accommodated in the magnetic gap, including a first fastening portion connecting to one end of the coil assembly in the magnetic gap, a second fastening portion fixed to the auxiliary magnet, and a connecting portion connecting the first fastening portion to the second fastening portion, wherein the auxiliary magnet includes a capacity-increased space for providing the suspension with an enlarged space to vibrate.

2. The speaker as described in claim 1, wherein the connecting portion of the suspension includes a waved cross-section along the vibration direction.

3. The speaker as described in claim 1, wherein the first fastening portion of the suspension forms a right angle with the coil assembly.

4. The speaker described in claim 1, wherein the auxiliary magnet includes a first auxiliary magnet and a second auxiliary magnet engaging with the first auxiliary magnet;

along a direction from the lower pole plate toward the diaphragm, the second auxiliary magnet has a gradually increased inner diameter, and the first auxiliary magnet has a gradually decreased inner diameter.

5. The speaker as described in claim 4, wherein the first auxiliarymagnet is symmetrical with the second auxiliary magnet about the second fastening portion of the suspension.

6. The speaker as described in claim 5, wherein the gradually increased/decreased inner diameter changes linearly.

7. The speaker as described in claim 4, wherein each of the first auxiliary magnet and the second auxiliary magnet includes an engaging surface, and the suspension is sandwiched between the two engage surfaces of the first and second auxiliary magnets.

8. The speaker as described in claim 7, wherein one of the engaging surfaces includes a fastening slot for fixing the second fastening portion of the suspension.

9. The speaker as described in claim 8, wherein the fastening slot is cooperatively formed by the two engaging surfaces.

10. The speaker as described in claim 1, wherein the upper pole plate includes a first upper plate covering the main magnet and a second upper plate covering the auxiliary magnet and forming a gap from the first upper plate.

* * * * *